United States Patent [19]

Wojdyla

[11] 4,205,770

[45] Jun. 3, 1980

[54] SELECTIVE FEEDING OF RECORD MEDIA

[75] Inventor: Gary A. Wojdyla, Ithaca, N.Y.

[73] Assignee: NCR Corporation, Dayton, Ohio

[21] Appl. No.: 906,286

[22] Filed: May 15, 1978

[51] Int. Cl.[2] ..... B65H 17/00

[52] U.S. Cl. ..... 226/49; 271/273; 400/607; 400/608.1; 101/228; 226/108

[58] Field of Search ..... 226/49, 51, 108, 110, 226/176, 177, 180, 181; 271/272, 273, 274; 400/605-607, 607.2, 607.3, 608.1; 101/228, 232

[56] References Cited

U.S. PATENT DOCUMENTS

| | | | |
|---|---|---|---|
| 3,444,977 | 5/1969 | Kinney et al. | 400/603.1 |
| 3,815,722 | 6/1974 | Sessoms | 400/26 |

FOREIGN PATENT DOCUMENTS

| | | | |
|---|---|---|---|
| 1134867 | 8/1962 | Fed. Rep. of Germany | 226/110 |

*Primary Examiner*—H. Grant Skaggs
*Attorney, Agent, or Firm*—J. T. Cavender; Wilbert Hawk, Jr.; George J. Muckenthaler

[57] ABSTRACT

A stepping motor drives an input shaft in a predetermined clockwise or counterclockwise direction and a pressure roller shaft is movable into engagement with rollers on the input shaft. The center roller of the input shaft is movable out of engagement with the center roller of the pressure shaft to permit driving of journal paper in a first direction, form paper in either a first or a second direction dependent upon the direction of rotation of the input shaft and journal paper along with form paper in the first direction.

24 Claims, 10 Drawing Figures

SELECTIVE FEEDING OF RECORD MEDIA

BACKGROUND OF THE INVENTION

In the field of feeding or delivering sheets of paper or other media or the like, drive means and idler means have been and are utilized and cooperate to cause a sheet of paper or like form to be moved along a path from a first position past an operating station to a second position. This feeding or delivering of sheets is relatively simple when the sheet or like form is always driven in one or the same direction.

Additionally, two sets of drive means could be used to provide the desired drive and control of a plurality of sheets, however, space limitations and the complexity of the two drive shafts may cause packaging problems and therefore do not enable the desired compactness of the unit.

Representative prior art in feeding and delivering of sheets such as record paper include U.S. Pat. No. 1,820,258, issued Aug. 25, 1931, to H. H. Vickers, disclosing a tally strip device which includes right and left sideplates fastened by a cross rod. A tally strip is overlaid by a carbon strip onto a spool with the tally strip and the carbon sheet being fed between a paper table and a platen by means of feed rolls which feed the record media or tally strip and the carbon sheet through one of two slots of a hollow spindle in a take-up roll or spool.

U.S. Pat. No. 2,069,489, issued Feb. 2, 1937, to W. A. Eagan, shows a billing machine wherein means is provided for feeding the sheets carried by an auxiliary carriage simultaneously with the vertical shifting of the sheet carried by the main carriage. A feed roller is supported on a shaft mounted for rotation in flanges of carriage members and cooperating with the feed roller is a tension roller supported on a floating shaft. The tension roller is moved out of contact with the feed roller to release the paper by a lever against the action of a spring. To permit different widths of sheets of paper to be driven, the feed roller and the tension roller and their supporting shafts, as well as a release rod are made in several sections with the sections being connected to other sections by a driving connection which includes a sleeve, a stem and a sleeve member to cause the sections to rotate together. A drive shaft transmits rotary motion to the feed rollers and the tension roller with the drive shaft having a pinion in mesh with a rack wheel carried at one end of the platen.

U.S. Pat. No. 2,777,386 issued Jan. 15, 1957, to G. H. Seeney, shows a multiple item receipt printing mechanism having a feed roll, a pressure roll cooperable with the feed roll, a first engaging mechanism operable to bring the rollers into engagement with one another during a part of the rotation of the feed roll so as to feed the record material a certain distance. A second engaging mechanism engages the rollers during a longer period of rotation of the feed roll so as to feed the record material a greater extent by means of a clutch to move the pressure roll to engaged position and a control device actuated upon operation of a control member to actuate the clutch.

U.S. Pat. No. 3,444,977, issued May 20, 1969, to M. E. Kinney et al. discloses mode selection for control of a plurality of work sheets wherein the machine has a front feed chute, split controls for the feed rolls to facilitate use of two forms, two manual levers for controlling the chute and the feed rolls and a clutch to permit feeding of forms on one side of the platen and on the other side of the platen or feeding of the forms on both sides of the platen.

U.S. Pat. No. 3,653,482, issued on Apr. 4, 1972 to A. Cortona et al., shows a front feeding device for a form and a rear feeding device for another form, and having a plurality of paper pressing rollers for clamping the forms to the underside of the platen. Means for clamping the paper above the platen and operating means for selectively opening and closing the pressing rollers and the clamping means are provided so that the two forms can be disposed, one alongside the other, to enable two different entries to be made during one operation.

U.S. Pat. No. 3,653,483, issued Apr. 4, 1972 to A. Cortona et al., shows a paper feed system comprising a platen, means for guiding paper sheets around the platen, a guide mechanism for continuous forms, a first device actuated to rotate the platen and carry the paper sheets, a second device actuated to carry the continuous forms independently of the journal sheets, and a continuously rotating drive shaft. Means are also provided to be actuated by the drive shaft through an actuating clutch with a first presetting clutch between the intermediate means and the first device, and a second presetting clutch between the intermediate means and the second device with programmed operating means adapted to cause engagement of the actuating clutch and of at least one of the presetting clutches.

U.S. Pat. No. 3,815,722 issued June 11, 1974 to J. M. Sessoms, discloses solenoid controlled paper handling mechanism wherein a guide assembly for passbooks or deposit slips is provided to be moved by solenoid actuation from one position to a second position, the first position being for inserting the passbook to a desired position, then actuating the solenoid for the guide means to move through a path to wrap the deposit slip around a portion of the platen and holding it during entry of the printed material. A gripping roller grips the passbook against the platen prior to the guide assembly wrapping the book around a portion of the platen between the gripping roller and a paper engaging portion of the guide assembly. The platen is then powerdriven to shift from one printing position to another so that the guide assembly can slide in slots from one position to the other in a path of travel from the first to the second position. The mechanism also provides side-by-side operation with a journal and receipt item handling mechanism which feeds a roll of paper from one roller to a second roller around the platen on a continuous basis and allows insertion of a deposit slip which allows entries on the deposit slip and on the journal paper and which grips the deposit slips in a similar manner and in a simultaneous operation with the passbook handling portion of the mechanism.

And, U.S. Pat. No. 3,908,883 issued Sept. 30, 1975 to G. Bellisai et al., discloses a one-chain bi-directional paper mover with first, second and third guide sections for transporting paper to and away from a print station. An endless non-elastic chain is engageable by a drive sprocket wheel and the chain is moved about the first and second guide sections and deflected inwardly by the third section for printing on the paper. The one-chain paper mover has replaced two separate superimposed and cooperating mover units with two chains which actuate a web or like document.

SUMMARY OF THE INVENTION

The present invention relates to feeding and delivering of record media and more particularly, to selective feeding of different record papers in at least two directions of travel and utilizing a single set of drive shafts for moving the record papers past a printing station.

A bi-directional stepping motor drives an input or drive shaft in incremental fashion in either clockwise or counterclockwise direction with a pressure shaft being rotated by the rotation of the drive shaft. The drive shaft and the pressure shaft have rollers thereon which drivingly engage the record paper therebetween by reason of a swinging action of the pressure shaft rollers into contact with the rollers of the drive shaft. There are three sets of rollers on such shafts, including a middle set of rollers for driving the journal paper and two outside sets of rollers for driving the form or slip paper, and wherein one set of the outside rollers is required for driving the narrow form paper while both sets of the outer rollers are used for driving the wide forms.

In one embodiment of the invention, the drive shaft is made up of three sectional portions, with the middle or center sectional portion being shiftable radially toward and away from the companion roller of the pressure shaft so as to provide independent feed of the journal paper as it is fed past the printing station.

In a second embodiment of the invention, the drive shaft is of one piece construction with the outer rollers being secured or fixed to the shaft and with the center roller being movable horizontally along the shaft in and out of alignment with the companion roller of the pressure shaft and including clutch means for causing rotation of such drive shaft in one direction.

The pressure shaft in each instance is of one-piece construction with all the pressure rollers fixed to the shaft and engageable with the rollers on the drive shaft to drive the record paper in the desired manner and direction—the slip paper by the outer rollers in each instance and the journal as determined by the positioning of the drive shaft center roller with respect to the companion roller on the pressure shaft.

In view of the above discussion, the principal object of the present invention is to provide a single set of record media feed shafts for transporting record media in either of two directions of travel.

Another object of the present invention is to selectively actuate a drive member to perform the desired operating mode for driving the record media.

An additional object of the present invention is to provide a set of drive members for feeding record media in one or another direction of travel.

A further object of the present invention is to provide a set of drive members for feeding one record media in one direction, for feeding the record media in the opposite direction, and for feeding the one record media along with a second record media in the first direction of travel.

Additional advantages and features of the present invention will become apparent and fully understood from a reading of the following description taken together with the annexed drawing.

DESCRIPTION OF THE PREFERRED EMBODIMENT

Figure 1:
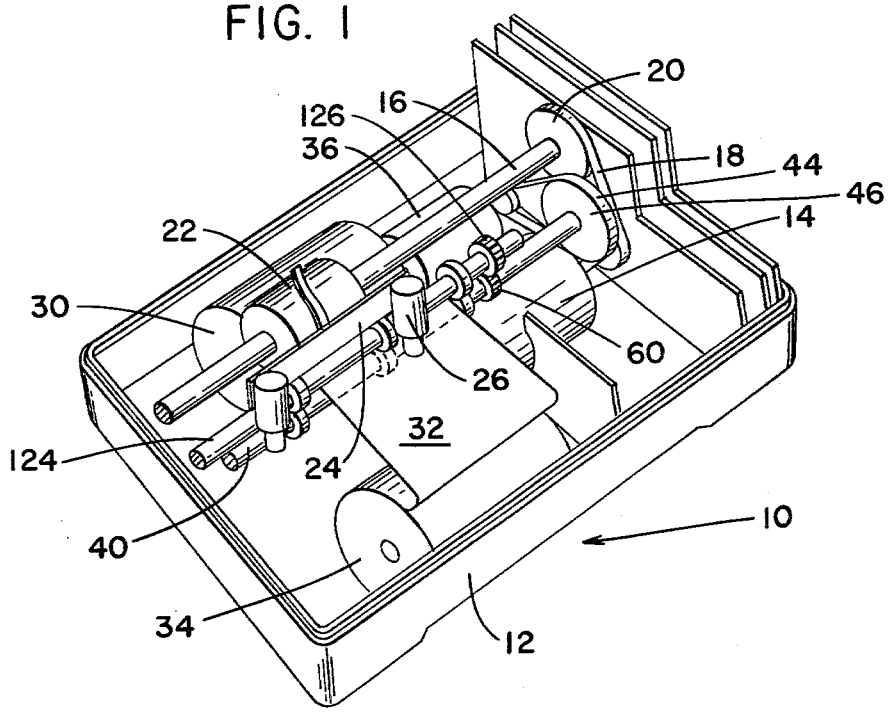
FIG. 1 is a left front perspective view of a portion of a printer incorporating the present invention.

Referring now to FIG. 1 there is shown a portion of a printer of the dot matrix type generally designated as 10 with the top cover and several parts being removed to more clearly show the various components related to or incorporated in the invention. The printer 10 is a single station 5×7 dot font matrix module for printing alpha and numeric characters on record media, such as a journal paper and inserted form paper. In operation the printer 10 is normally used by either of two bank tellers for purposes of validation, check, money order and ledger printing.

A lower enclosure 12 contains the several elements wherein the main drive source is a direct current motor 14 located at the right hand side of the printer 10 for driving a cam shaft 16 by means of a timing belt 18 trained around a drive pulley 20. The cam shaft 16 carries a drum shaped cam 22 for driving a print solenoid carriage 24 in a back and forth direction across the printer 10. The drum cam 22 is engaged with suitable cam followers (not shown) on the carriage 24 for the purpose of converting the rotary motion of the cam shaft 16 into lateral motion for the solenoid carriage 24.

The printer 10 utilizes eight laterally spaced print solenoids 26 which are carried on the carriage 24 and moved horizontally to span ten characters per solenoid. A journal paper supply roll 30 is located at the rear of the printer and the journal paper 32 is caused to be wound on a take-up roll 34 by means of a stepper motor 36 which is also located at the right side of the printer. The journal paper 32 is fed or advanced on a horizontal plane under the print solenoids 26. The inserted forms or slips are also fed or driven on a horizontal plane in both fore and aft directions by the stepper motor 36 so as to cause feeding of a form into the printing area or for reversing direction and feeding the printed form out of the printer 10.

While the printer 10 is a complete unit and consists of printing mechanism, power supply, ribbon mechanism, forms thickness compensation, the journal paper supply and takeup, a bi-directional inserted forms drive mechanism, the main drive and stepper motors, a number of forms sensors, special function solenoids and electronic boards, the present invention resides in the feeding of the journal paper 32 and inserted forms or slips in two directions when utilizing a single set of record paper feed shaft members 40 and 124. Suffice it to say that each horizontal movement of the print solenoids 26 results in one dot row being printed and that one printed line of characters requires seven passes of the print solenoid carriage 24. The first pass of the assembly prints the bottom row of dots of the characters, and the journal paper and the inserted form, if present in the printer 10, are both fed or advanced forward toward the front of the printer for printing of the next dot row and the carriage assembly 24 then makes a second pass to print the second row of dots. This alternating printing and paper feeding continues until the seven dot rows are printed, thus completing one printed line of characters with all characters being printed in ascending order or from bottom to top. The journal paper 32 is always driven in the forward direction or toward the operator and printing is always done in ascending order whereas the inserted form or slip is fed bi-directionally either toward or away from the operator and the inserted form may be printed in either ascending or descending order. The maximum capacity on the journal paper is 50 print columns, and the maximum capacity on the inserted form is 80 print columns. The journal paper 32 may be single or double ply paper and the inserted forms may be one to four part paper with the inserted form overlapping the journal print area and being fed along a horizontal path above the journal paper 32.

In most cases, the inserted form contains the last printed line at the bottom of the form for descending print order so that the form must be fed into the printer or away from the operator after each line is printed. Since the journal 32 is always fed forward or toward the operator, a disengage and engage mechanism is provided so the journal will not advance or move during an in-feed of the inserted form. However, there are some cases where the last printed line appears at the top of the form which is ascending print order and both the journal and the form are caused to be driven together toward the front of the printer 10 or toward the operator.

The record paper feed shafts 40 and 124 are driven by the stepper motor 36 through a timing belt 44 which is trained around a pulley 46 secured to the shaft 40.

Figure 2:
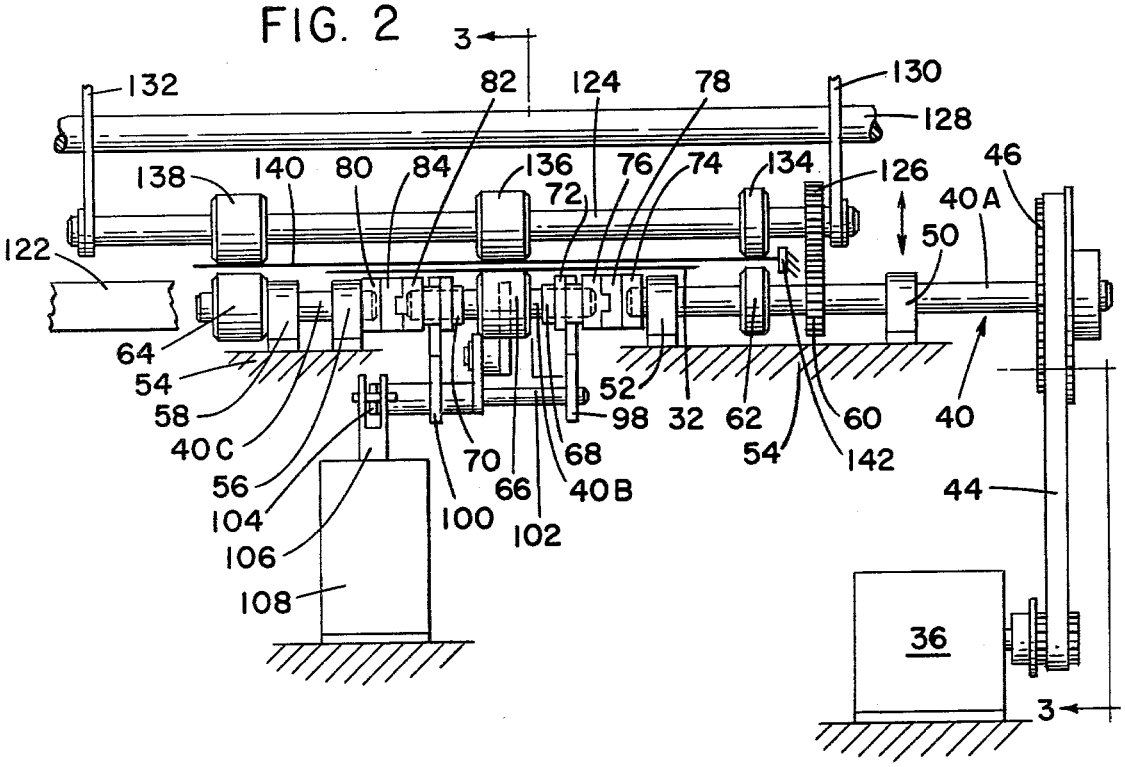
FIG. 2 is a front elevational view of the operating parts of the printer in the home position.
Figure 3:
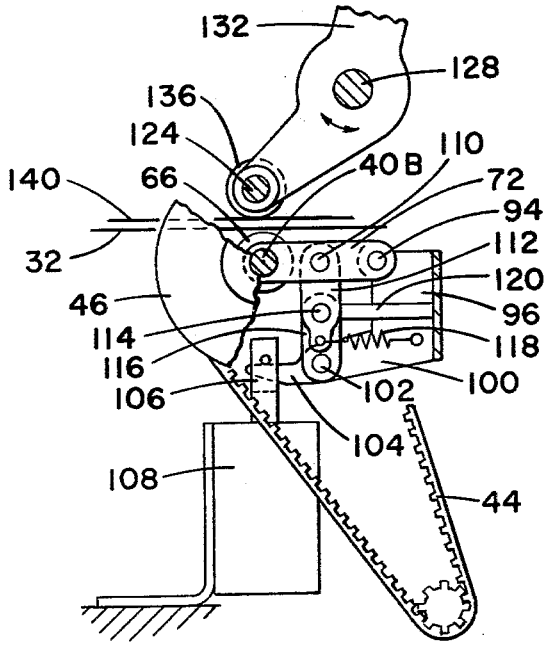
FIG. 3 is a side elevational view, partly in section, of the parts shown in FIG. 2 and taken along the plane 3—3 thereof.

Referring now to FIGS. 2 and 3, the input or drive shaft 40 comprises three separate portions, 40A, 40B and 40C, the portion 40A being on the right side of the printer 10 and supported from and journaled in bearings 50 and 52, which are secured to a frame member 54. The left side shaft portion 40C is likewise supported from and journaled in bearings 56 and 58, which are secured to the frame member 54. However, the central shaft portion 40B is designed and constructed to be lowered from an alignment position with shaft portions 40A and 40C. The shaft portion 40A has a drive gear 60 and a drive roller 62 secured thereto approximately halfway between the bearings 50 and 52 and the shaft portion 40C has a drive roller 64 adjacent the bearing 58. A drive roller 66 is carried on the central shaft portion 40B between a pair of sleeves 68 and 70, which sleeves form bearings for a journal bracket 72 which is U-shaped and extends rearwardly from the shaft portion 40B (FIG. 3).

Figure 4:
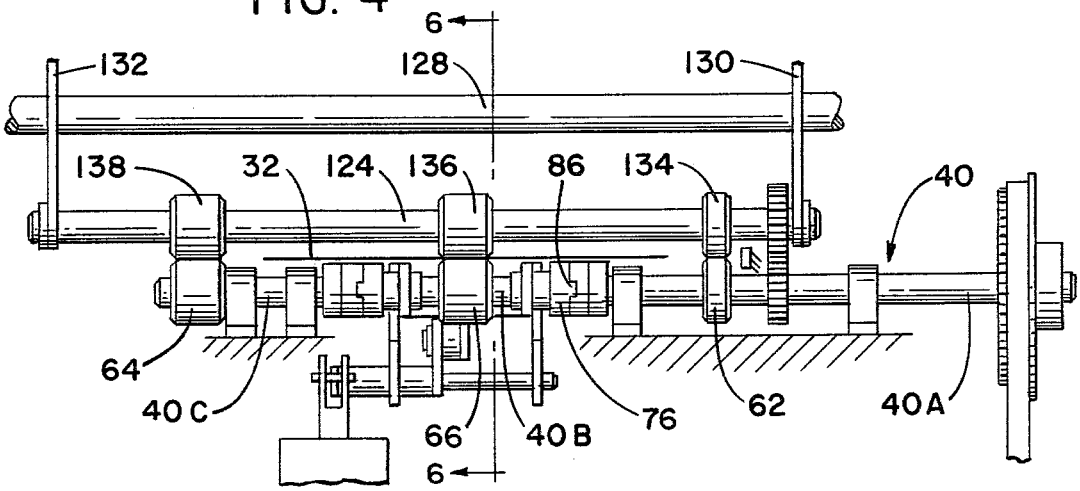
FIG. 4 is a front elevational view similar to FIG. 2 and showing the feeding of one record media in one direction.
Figure 5:
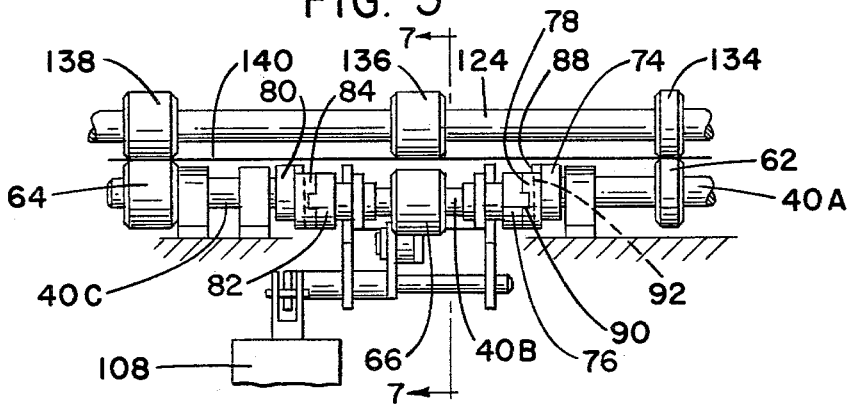
FIG. 5 is a similar view and showing the feeding of another record media in one direction or in another direction dependent upon direction of rotation of the drive shaft.

A right side coupling comprises a hub 74 secured to the shaft portion 40A and a hub 76 secured to the shaft portion 40B with a plastic disc 78 placed between the hubs 74 and 76 for operation therewith. A like left side coupling comprises a hub 80 which is secured to the shaft portion 40C and a hub 82 secured to the shaft portion 40B with a plastic disc 84 between the hubs. As also seen in FIGS. 4 and 5, the hub 76 has a lip 86 extending across one face thereof and the hub 74 has a similar lip 88 extending across the opposed face thereof and at a right angle or disposed at 90° to the lip 86 wherein the lips operate in respective slots or grooves 90 and 92 in the plastic disc 78 with the slots also being disposed at right angles to each other. A like lip and slot arrangement is provided between the hubs 80, 82 and disc 84 of the left side coupling (FIG. 5). The design and construction of the lips and slots in the discs 78 and 84 permits a sliding action between the hubs 74 and 76 and the hubs 80 and 82 upon rotation of the drive shaft 40.

The journal bracket 72 (FIG. 3) is pivoted at a pin 94 to a fixed support bracket 96 which has forwardly extending arms 98 and 100 (FIG. 2) and supporting a pivot pin 102 which has secured thereto a forwardly extending finger 104 for connection with an armature plunger 106 of a solenoid 108. A pivot pin 110 is carried by the U-shaped bracket 72 and supports a downwardly extending arm 112 which is pivoted at pin 114 and operates with a link 116 connected with the pins 102 and 114. A spring 118 is connected at one end thereof to the lower end of the arm 112 and at the other end thereof to the support bracket 96. Additionally, a stop pin 120 is secured at one end to the support bracket 96 and is engageable at the other end by the arm 112 to limit or position the rearward travel of the arm 112 against the action of the spring 118. Energization of the solenoid 108 causes the plunger 106 to move downwardly and rotates the finger 104 counterclockwise on the pin 102, which rotation causes the arm 112 to rotate clockwise about the pin 110 against the action of the spring 118. This movement of the various parts causes a downward travel of the forward portion of the journal bracket 72 in a rocking or pivoting motion about the pin 94 and displaces the shaft portion 40B with its roller 66 downwardly to a position below the top plane surface of a platen 122, which platen extends across the printer 10 forward of the main drive shaft 40.

The cooperating or pressure shaft 124 is disposed or positioned above the input or drive shaft 40 and includes a gear 126 meshing with and driven by the gear 60 on the drive shaft 40, with the pressure shaft 124 being supported from a support member or shaft 128 through the use of links or arms 130 and 132. The shaft 124 has rollers 134, 136 and 138 spaced therealong to match and cooperate with the drive rollers 62, 66 and 64, the shaft 124 being swingably movable by means of the arms 130 and 132 on shaft 128, in the motion as shown by the arrow in FIG. 3, to engage the rollers on the shaft 124 with the rollers on shaft 40.

The location of the shaft 124 in relation to the shaft 40 in FIGS. 2 and 3 represents a home or unactuated position of the paper drive mechanism wherein the journal paper 32 is shown as occupying the central portion of the shafts 124 and 40, and an inserted form 140 occupies a wider space and is engageable by the rollers 134 and 138 for driving or feeding of the form 140 in one or the other direction. A right side guide 142 is provided for the form 140 wherein the form is justified to or maintained against the guide when moving into and out of the printer 10.

Figure 6:
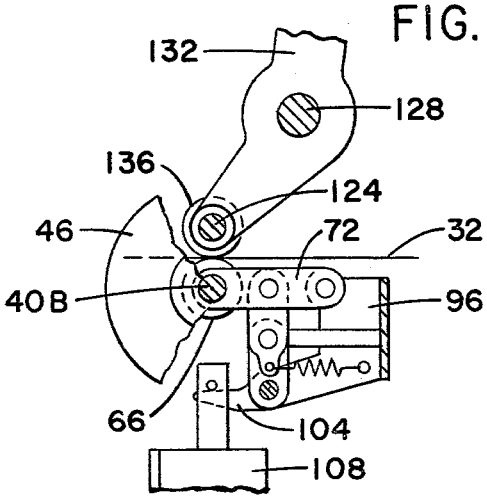
FIG. 6 is a view taken along the plane 6—6 of the structure shown in FIG. 4.

FIGS. 4 and 6 show the drive shaft 40 and its associated parts in the same position as shown in FIGS. 2 and 3, whereas the pressure shaft 124 has been swung counterclockwise as seen in FIG. 6 to cause the rollers on shaft 124 to engage with the rollers on the drive shaft 40 and to drive the journal paper 32 from the supply roll 30 onto the take-up roll 34. This is, of course, assuming that there is no form inserted into the printer. As illustrated, the journal paper 32 is only of such width to be engaged with and driven by the central set of rollers 66 and 136. The stepper motor 36 is actuated to drive the drive shaft 40 in a counterclockwise direction which causes movement of the journal paper 32 from the back of the printer 10 to the front or from the supply roll 30 to the take-up roll 34.

Figure 7:
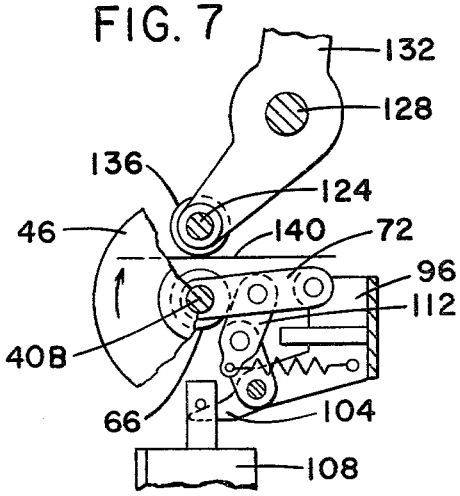
FIG. 7 is a view taken along the plane 7—7 of the structure shown in FIG. 5.

When it is desired to feed or drive a form 140 into printing 10 position from the front of the printer, the solenoid 108 is energized to lower the central shaft portion 40B, which disengages the roller 66 from roller 136, as seen in FIGS. 5 and 7. The right and the left couplings allow the drive shaft 40 to be rotated in one or the other direction of rotation. When the central shaft portion 40B is in the lower or solenoid-actuated position, the pressure shaft 124 is swung downwardly to engage the rollers 62 and 134 and to engage the rollers 64 and 138, whereupon the stepper motor 36 is actuated to rotate the drive shaft 40 in a clockwise direction. Since the roller 64 is lowered from contact with the roller 136, there is no driving engagement for feeding the journal paper 32. If the width of the inserted form 140 spans the distance from the right set of rollers 62 and 134 past the center rollers 66 and 136, only such right set of rollers drive the form 140 inward or toward a printing position. This of course assumes that the form paper 140 does not extend to the rollers 64 and 138 to be driven thereby, in which case, if the width of the forms paper is sufficiently wide, then both outside (left and right) sets of rollers would drive the form 140, as illustrated in FIG. 5.

When it is desired to feed the form 140 from rear to front or out of the printer 10, the solenoid 108 is energized to lower the shaft portion 40B and the stepper motor 36 rotates the drive shaft 40 in the counterclockwise direction of rotation. While the upper roller 136 on the pressure shaft 124 may be in contact with the form 140, the force is insufficient to feed the paper 32 from the supply roll 30 to the take-up roll 34.

Figure 8:
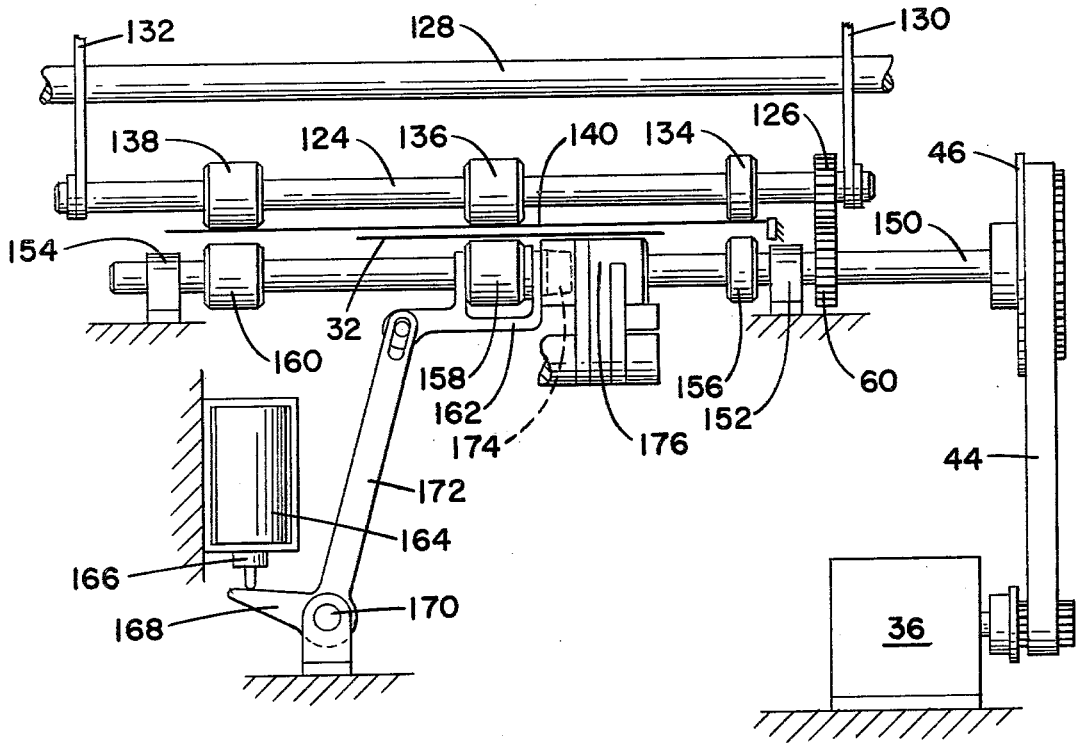
FIG. 8 is a modification of the invention and showing the operating parts of the printer in the home position.
Figure 9:
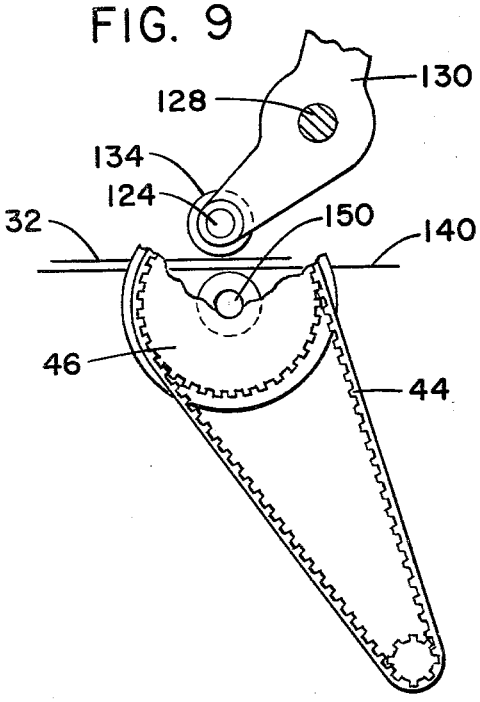
FIG. 9 is a side view of the parts shown in FIG. 8.

FIGS. 8 and 9 illustrate a modification of the invention which utilizes a number of the same parts, such as the stepper motor 36, the timing belt 44, and the main drive pulley 46. The upper pressure shaft 124 includes the rollers 134, 136, 138, and is supported through the arms 130 and 132 from the shaft or member 128, and such pressure shaft 124 is driven through the gears 60 and 126. The pulley 46 is secured to and drives a main drive shaft 150 which is supported in bearings 152 and 154 and includes drive rollers 156, 158 and 160 which cooperate with the pressure shaft rollers 134, 136 and 138.

For the purpose of selective feeding of different papers in two directions with the single set of drive and pressure shafts 150 and 124, the center drive roller 158 on the shaft 150 is movable horizontally so as to engage with and disengage from the companion roller 136. A yoke member 162 contains the roller 158, with such roller including a one-way clutch of common design to permit rotation of the roller in one direction only, i.e., the shaft 150 not effectively driving the roller 158 in one direction but causing effective driving in the other direction of rotation.

Figure 10:
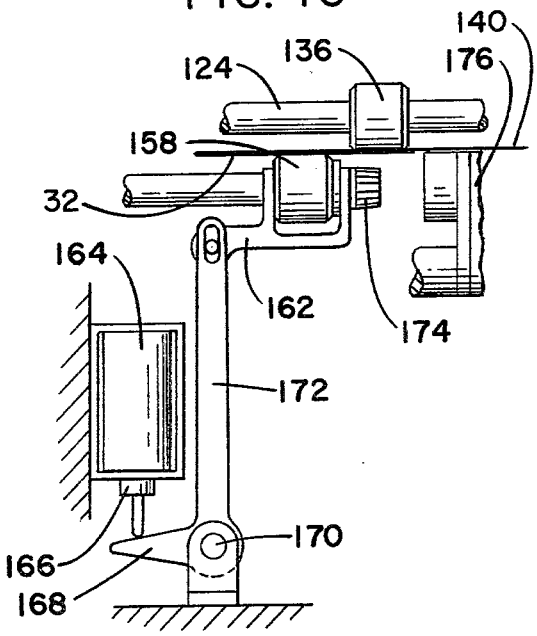
FIG. 10 is a front elevational view of the center drive roller in a disengaged position from the position shown in FIG. 8.

When it is desired to feed the form 140 into the printer 10, a solenoid 164 is energized to move its plunger 166 downwardly and cause an arm 168 to be rotated about a pivot pin 170 in a counterclockwise direction, the upper extension 172 of which is connected with the yoke member 162. A male splined portion 174 of the drive shaft 150 is caused to be engaged with and disengaged from a driving hub assembly 176 on such drive shaft 150, wherein the roller 158 on such shaft 150 is caused to be shifted to the left or in an offset position with respect to its companion roller 136, as seen in FIG. 10. When the pressure shaft 124 is actuated to swing its rollers 134, 136 and 138 into contact with the drive shaft rollers 156, 158 and 160, in a counterclockwise direction as seen in FIG. 9, the form 140 is driven only by the right set of rollers 156/134, or if sufficiently wide, also indirectly by the left set of rollers 138/160 as the center rollers 136 and 158 cannot feed or drive either the journal 32 or the form 140 by reason of their offset position. The journal 32 is not driven when the drive shaft 150 rotation is clockwise, and even though such shaft 150 rotates within the center roller 158, the roller is not positively driven by reason of the one-way clutch associated therewith.

When it is desired to drive or feed only the form 140 out of the printer 10, the solenoid 164 is actuated, the pressure shaft 124 is swung downwardly to cause engagement of the outside pairs of rollers, and the input or drive shaft 150 is caused to be driven in a counterclockwise direction of rotation. The lower center roller 158 would be drivingly rotated by reason of the one-way clutch, but would not drive the journal paper 32.

It is thus seen that herein shown and described is an apparatus for selectively feeding or driving of different papers in either of two directions with a single set of feed shafts. The mechanism enables the accomplishment of the objects and advantages mentioned above, and while a preferred embodiment and one modification of the invention have been disclosed herein, other variations thereof may occur to those skilled in the art. It is contemplated that all such variations and modifications not departing from the spirit and scope of the invention hereof are to be construed in accordance with the following claims.

What is claimed is:

1. In a printer, apparatus for selectively feeding different record media in two directions of travel comprising:

drive means having a movable portion, means for driving said drive means in one or the other direction of rotation, driven means positioned to be driven by said drive means, said drive means and said driven means having a plurality of opposed record media engaging rollers, means for moving said driven means rollers toward engagement with said drive means rollers for feeding one record media in one direction upon rotation of said drive means in one direction, and means for moving said movable portion of said drive means away from said driven means to enable feeding of another record media in the direction opposite said one direction upon rotation of said drive means in a direction opposite said one direction, and to enable feeding of said another record media in said one direction upon rotation of said drive means in said one direction, and for feeding said one record media and said another record media in said one direction upon moving said movable portion of said drive means toward said driven means and upon rotation of said drive means in said one direction.

2. The apparatus of claim 1 wherein said drive means comprises a shaft having spaced rollers thereon and said movable portion comprises a central portion thereof including at least one of said rollers thereon.

3. The apparatus of claim 1 wherein said means for driving said drive means comprises a stepping motor.

4. The apparatus of claim 1 wherein said driven means comprises a shaft having spaced rollers thereon.

5. The apparatus of claim 1 wherein said means for moving said driven means rollers comprise arm members carried on a shaft for swinging said rollers toward engagement with said drive means rollers.

6. The apparatus of claim 1 wherein said means for moving said movable portion of said drive means comprises a solenoid energized for swinging said movable portion from said driven means.

7. The apparatus of claim 1 wherein said means for moving said movable portion of said drive means comprises a solenoid energized for sliding said movable portion along said drive means.

8. The apparatus of claim 1 wherein said one record media comprises a journal positioned for feeding by centrally positioned drive and driven rollers in one direction.

9. The apparatus of claim 1 wherein said another record media comprises a form positioned for feeding by outer drive and driven rollers in said one direction and for feeding said form in the direction opposite said one direction.

10. In a printer, means for moving record media in two directions of travel, comprising a drive member;

means for driving said drive member in one and in the other direction of rotation, a driven member engageable with and disengageable from said drive member, first record media positioned to be moved in one direction, second record media positionable to be moved in said one direction and in an opposite direction, means for moving said driven member toward engagement with said drive member for moving said first record media in said one direction upon rotation of said drive member in one direction, and means for moving a portion of said drive member away from said driven member to enable feeding of said second record media in said opposite direction upon rotation of said drive member in the direction opposite said one direction, and to enable feeding of said second record media in said one direction upon rotation of said drive member in said one direction, and for feeding said first record media and said second record media in said one direction upon rotation of said drive member in said one direction.

11. In the printer of claim 10 wherein said drive member comprises a shaft having rollers spaced thereon and said drive member portion comprises a central portion thereof.

12. In the printer of claim 10 wherein said means for driving said drive member comprises a stepping motor.

13. In the printer of claim 10 wherein said driven member comprises a shaft having rollers spaced thereon corresponding to the drive member.

14. In the printer of claim 10 wherein said means for moving a portion of said drive member comprises a solenoid energized for swinging said drive member portion from said driven member.

15. In the printer of claim 10 wherein said means for moving a portion of said drive member comprises a solenoid energized for sliding said drive member portion along said drive member.

16. In the printer of claim 10 wherein said first record media comprises a journal positioned for feeding by the central portions of said drive member and said driven member.

17. In the printer of claim 10 wherein said second record media comprises a form positioned for feeding by spaced portions of said drive member and said driven member in said one direction and for feeding said form in said opposite direction.

18. In the printer of claim 10 wherein said drive member and said driven member each include rollers spaced therealong in opposing manner and at least one drive roller on said drive member is movable from engagement with the roller on said driven member.

19. In a printer, drive mechanism for driving one record media in one direction of travel and for driving another record media in said one direction and in the opposite direction of travel in overlapped manner comprising:

elongated drive means having a movable portion, elongated driven means engageable with and disengageable from said drive means, means for driving said drive means in one direction of rotation and in the opposite direction of rotation, means for swinging said driven means toward engagement with said drive means, and means for moving said movable portion of said drive means away from said driven means to enable driving of said another record media in said opposite direction of travel upon rotation of said drive means in said opposite direction of rotation, and to enable driving of said one record media and said another record media in said one direction of travel upon moving said movable portion of said drive means toward said driven means and upon rotation of said drive means in said one direction of rotation.

20. The drive mechanism of claim 19 wherein said elongated drive means comprises a drive shaft having rollers spaced thereon and said movable portion comprises a central portion of said shaft.

21. The drive mechanism of claim 19 wherein said means for driving said drive means comprises a stepping motor.

22. The drive mechanism of claim 20 wherein said elongated driven means comprises a driven shaft having rollers spaced thereon corresponding to the rollers on said drive shaft.

23. The drive mechanism of claim 19 wherein said means for moving said movable portion comprises a solenoid energizable for swinging said movable portion from said driven means.

24. The drive mechanism of claim 19 wherein said means for moving said movable portion comprises a solenoid energizable for sliding said movable portion along said drive means.

* * * * *